US008707642B2

(12) United States Patent
Nahas

(10) Patent No.: US 8,707,642 B2
(45) Date of Patent: Apr. 29, 2014

(54) SHEET MATERIAL HANGING METHODS AND HANGING MEMBERS THEREFORE

(76) Inventor: Michael G. Nahas, Cuyahoga Falls, OH (US)

( * ) Notice: Subject to any disclaimer, the term of this patent is extended or adjusted under 35 U.S.C. 154(b) by 713 days.

(21) Appl. No.: 10/193,397

(22) Filed: Jul. 11, 2002

(65) Prior Publication Data

US 2004/0006948 A1 Jan. 15, 2004

(51) Int. Cl.
*E04B 2/00* (2006.01)

(52) U.S. Cl.
USPC ..... 52/275; 248/224.51

(58) Field of Classification Search
USPC ..... 52/287.1, 746.11, 288.1, 512, 506.05, 52/582.1, 581.1, 747.1, 98, 281, 417
See application file for complete search history.

(56) References Cited

U.S. PATENT DOCUMENTS

| | | | | | |
|---|---|---|---|---|---|
| 552,939 | A | | 1/1896 | Wahl et al. | |
| 1,078,714 | A | | 11/1913 | Brownstein | |
| 1,787,038 | A | | 12/1930 | Geoffray | |
| 2,594,928 | A | | 4/1952 | Horowitz | |
| 2,889,016 | A | | 6/1959 | Warren | |
| 3,005,293 | A | | 10/1961 | Hunter | |
| 3,712,015 | A | | 1/1973 | Nelson | |
| 3,831,333 | A | | 8/1974 | Nelsson et al. | |
| 3,854,259 | A | | 12/1974 | Lechene | |
| 3,881,293 | A | | 5/1975 | Conville | |
| 3,967,432 | A | | 7/1976 | Starr | |
| 3,999,343 | A | | 12/1976 | Roberts | |
| 4,333,286 | A | * | 6/1982 | Weinar | 52/281 |
| 4,392,336 | A | * | 7/1983 | Ganssle | 52/417 |
| 4,394,808 | A | | 7/1983 | Thorsell | |
| 4,435,935 | A | * | 3/1984 | Larrea | 52/461 |
| 4,435,936 | A | | 3/1984 | Rutkowski | |
| 4,455,794 | A | | 6/1984 | MacKinnon, Jr. | |
| 4,555,885 | A | * | 12/1985 | Raymond et al. | 52/468 |
| 4,596,094 | A | | 6/1986 | Teller et al. | |
| 4,649,689 | A | | 3/1987 | Everman et al. | |
| 4,651,484 | A | | 3/1987 | Rutkowski | |
| 4,674,242 | A | | 6/1987 | Oboler et al. | |
| 4,713,921 | A | | 12/1987 | Minialoff et al. | |
| 4,722,153 | A | * | 2/1988 | Hardy | 52/255 |

(Continued)

FOREIGN PATENT DOCUMENTS

| | | |
|---|---|---|
| AU | 259759 | 6/1964 |
| GB | 2260346 | 4/1993 |
| IT | 678933 | 12/1964 |
| SU | 259759 | 6/1965 |

*Primary Examiner* — Steven Marsh
(74) *Attorney, Agent, or Firm* — Renner, Kenner, Greive, Bobak, Taylor & Weber Co., L.P.A.

(57) ABSTRACT

A sheet member fastening system and kit, as well as methods of hanging sheet members on a framework for a wall or ceiling surface are described. Fastening members, comprising substantially flat members and corner members are usable to enable edges of standard sheet members, such as wallboard or the like, to be properly supported and attached adjacent one another by means of the fastening members. The use of the fastening members enables hanging of sheet members on the framework without cutting of the sheet members or measuring of the relationship of the sheet member to the underlying framework, except adjacent a corner of the wall/ceiling surface. The fastening members allow attachment of the edges when not positioned directly on a frame member to properly secure the edges relative to one another. The fastening members are made of a material to accept fastening devices such as screws, staples, nails or the like to secure the sheet members thereto.

6 Claims, 6 Drawing Sheets

(56) References Cited

U.S. PATENT DOCUMENTS

| | | | | | |
|---|---|---|---|---|---|
| 4,757,663 | A | | 7/1988 | Kuhr | |
| 4,763,455 | A | * | 8/1988 | Schneller | 52/255 |
| 4,782,642 | A | | 11/1988 | Conville | |
| 4,796,396 | A | | 1/1989 | Menchetti | |
| 4,837,988 | A | | 6/1989 | Menchetti et al. | |
| 4,843,784 | A | | 7/1989 | Menchetti et al. | |
| 4,854,096 | A | | 8/1989 | Smolik | |
| 4,866,899 | A | | 9/1989 | Houser | |
| 4,902,179 | A | | 2/1990 | Harker | |
| 4,977,718 | A | * | 12/1990 | Hoffman, Sr. | 52/287.1 |
| 4,995,605 | A | | 2/1991 | Conville | |
| 5,060,434 | A | | 10/1991 | Allison | |
| 5,067,296 | A | | 11/1991 | Brown et al. | |
| 5,095,678 | A | | 3/1992 | Murphy | |
| 5,177,925 | A | | 1/1993 | Winkler et al. | |
| 5,189,850 | A | | 3/1993 | Felton | |
| 5,274,973 | A | | 1/1994 | Liang | |
| 5,313,755 | A | * | 5/1994 | Koenig, Jr. | 52/255 |
| 5,325,641 | A | | 7/1994 | Felton | |
| 5,351,452 | A | | 10/1994 | Gates | |
| 5,408,796 | A | | 4/1995 | Hashimoto et al. | |
| 5,426,904 | A | | 6/1995 | Gilmore | |
| 5,452,556 | A | | 9/1995 | Taylor | |
| 5,475,961 | A | | 12/1995 | Menchetti | |
| 5,485,706 | A | | 1/1996 | Menchetti | |
| 5,515,658 | A | | 5/1996 | Jorde | |
| 5,657,599 | A | * | 8/1997 | Peterson et al. | 52/417 |
| 5,706,621 | A | | 1/1998 | Pervan | |
| 5,752,353 | A | * | 5/1998 | Koenig et al. | 52/255 |
| 5,799,458 | A | * | 9/1998 | Ferguson | 52/417 |
| 5,987,846 | A | | 11/1999 | Nahas | |
| 6,108,990 | A | * | 8/2000 | Klamer | 52/281 |
| 6,138,425 | A | * | 10/2000 | Wendt | 52/506.07 |
| 6,212,836 | B1 | * | 4/2001 | Larson | 52/287.1 |
| 2002/0033000 | A1 | * | 3/2002 | Pantelides et al. | 52/745.05 |
| 2003/0033770 | A1 | * | 2/2003 | Harel | 52/287.1 |
| 2003/0059277 | A1 | * | 3/2003 | O'Berry | 411/413 |

* cited by examiner

SHEET MATERIAL HANGING METHODS AND HANGING MEMBERS THEREFORE

BACKGROUND OF THE INVENTION

The present invention relates generally to sheet material hanging methods and hanging members for use in construction of wallboard surfaces. More particularly, the present invention relates to sheet material hanging methods, wherein hanging members are utilized to facilitate the installation of sheet materials, such as wallboard, plywood or the like. Wallboard sheet materials are typically used in residential, commercial and industrial structures during both new construction and/or renovation. Wallboard products include interior gypsum drywall wallboard and exterior sheetrock, such as GYPROCK®, a product manufactured by United States Gypsum in Chicago, Ill. Other sheet materials may also be accommodated, such a plywood sheeting of exterior building surfaces, interior paneling, partitioning or the like.

When installing wallboard or the like in residential, commercial and industrial structures, it is necessary to form a wallboard surface wherein sheets of wallboard are individually hung and mated with one another such that the edges of the wallboard are positioned directly adjacent one another to form a substantially smooth surface. At the interfaces between the wallboard, support for each of the board members must be provided to ensure proper mating of the surfaces to form an aesthetically pleasing surface as well as a surface having the needed structural integrity. Heretofore, as an example, a wall or ceiling surface is formed by securing the opposing edges of an individual wallboard member to studs or joists present in the walls and/or ceilings of the structure as framed. Attachment of pieces of wallboard to the studs or joists is typically made using mechanical fasteners, such as nails, staples or threaded screws, although adhesives may also be used. Studs or joists present in the walls and/or ceilings of a structure are normally placed a relatively constant predetermined distance apart, typical distances being twelve (12) inches, sixteen (16) or twenty four (24) inches from the centerline of one stud or joist to the centerline of the next stud or joist. Furthermore, pieces of wallboard, such as gypsum drywall wallboard, are normally fabricated to a predetermined size, typical sizes varying from four (4) or four and one half (4½) feet in width by eight (8), ten (10), twelve (12) feet, fourteen (14) and sixteen (16) in length. In some cases, rounded structures may be formed by suitable framing and bending of the sheet material.

Although in theory the wallboard sizes and stud or joist spacing should facilitate securing the edge of the board to a stud or joist without having to cut or otherwise modify the wallboard, variations are present in the sizes of wallboard and/or the positioning of studs or joists. Further, in many instances, the studs or joists are not compatibly arranged due to the configuration of the structure or building itself, or the placement of the studs or joists are not arranged in uniform spaced relationship, which particularly may occur at or near corners of the structure. Additionally, variations can occur due to, for example, material tolerances and expansion, contraction, bending and/or warpage of the studs or joists, as well as mismeasurement and/or mislocation of the studs or joists during framing of the structure. In addition, significant dimensional variations are often present in pieces of wallboard due to manufacturing tolerances, as well as material expansion, contraction and/or warpage. Further, in some situations, the framer simply cannot evenly space studs, and the room or roof configuration may require framing which would not accommodate normal hanging procedures, due to building structures such as hip roofs or the like. Accordingly, opposing edges of the wallboard often do not align with a stud, joist or another existing structural member as desired. Therefore, it is currently customary practice for an installer to initially measure the particular relationship of studs or joists in the area to which the wallboard is to be applied, and then to cut a standard piece of wallboard to fit the particular arrangement of studs/joists or the like. It should be recognized that any such cutting or trimming results in waste or "scrap" since the entire piece of wallboard is not being utilized. In some cases, an installer may attempt to select particular pieces of wallboard for installation in particular locations, which although potentially saving some scrap, requires relatively sophisticated calculation and planning, which in turn requires a more highly skilled installer and significant labor and time. In addition, even if a wallboard edge does fall on a stud or joist, problems still exist in properly securing the board edges to the stud or joist due to its relatively small size. The nails, screws or other securing devices must be located directly adjacent the edge, thereby weakening this area of the board and promoting the likelihood of nail popping or the like.

In typical installation procedures, based upon the foregoing problems encountered by installers, it is customary practice to place cut edges, when possible, into corner joints and to use factory cut edges in interior joints. However, this is not always feasible and, particularly when multiple cuts are made to the wallboard pieces, situations occur when the cut edges, are used at an interior wall or ceiling joint. This typically requires additional time and effort in achieving a smooth and straight cut and, even so, may result in a less than desirable match-up between adjacent wallboard pieces in an interior joint. It would thus be desirable to minimize the need to cut standard wallboard members in the installation on a wall/ceiling frame structure. Additionally, at corner portions of the structure, the boards must be fit to the corner, and do not allow access to the corner stud on the next wall section. This requires the installer to consume time in properly securing the next wallboard section at the corner. In other instances, the framing configuration makes it extremely difficult to efficiently position wallboard, and if the installer is to avoid a large amount of scrap, the layout for the room or the like must be considered prior to installation. It would be worthwhile to provide a system and method wherein the time and effort needed to layout the positioning of the individual wallboard members is eliminated.

SUMMARY OF THE INVENTION

Accordingly, it is an object of the invention to provide methods to install wallboard and a wallboard hanging system as well as fastening members to install wallboard members to form a wall/ceiling surface in association with a frame construction. The invention overcomes the problems associated with prior installation methods, allowing the installer to simply position and hang the individual wall board members without regard to the positioning of studs in the frame structure. It is a further object to provide methods and wallboard fastening members, which minimize the generation of scrap, thereby providing a cost-effective installation process. The invention is also directed to wallboard fastening members, which are inexpensive to fabricate, easy to use, and which facilitate the installation of wallboard in residential, commercial and industrial structures.

These and other objects of the present invention are attained by the provision of a wallboard fastening method for covering a framework having a plurality of frame members arranged relative to one another to form at least one wall/ ceiling surface section and at least one corner comprising a first step of locating the position of a first standard wallboard member and securing a first end of the standard wallboard to a first frame member of the at least one wall/ceiling surface section. A second step provides a first fastening member and securing the fastening member in a position adjacent a second end of the first wallboard member opposed to the first end. A third step of the method provides that the second end of the sheet member is secured to the first fastening member. The steps one through three are then repeated for additional standard wallboard members using additional wallboard fastening members on at least one flat surface section of the framework to the at least one corner. The size of wallboard members adjacent the at least one corner selectively sized to be secured to a frame member at the at least one corner. A fourth step provides a second type of fastening member which is secured to a frame member at the at least one corner to extend outwardly to a position for securing an additional standard wallboard member thereto. Thereafter, steps one through three are again repeated to completely cover any further wall/ceiling surface section from the at least one corner, and step four is repeated for any further corner to completely cover the plurality of frame members arranged relative to one another to form at least one wall/ceiling surface section and at least one corner.

The invention is also directed to a wallboard fastening system comprising at least one first substantially flat fastening member for selective attachment to a plurality of frame members arranged relative to one another to form at least one wall/ceiling surface section, and at least one corner fastening member for selective attachment to a frame member forming a corner portion of a wall/ceiling surface. The at least one first substantially flat fastening member and at least one corner fastening member are selectively secured to at least one frame member to allow securing of an end of a wallboard member thereto, without having to cut the wallboard member. The flat fastening members are adapted to be positioned as a wall or ceiling stud or joist between existing studs or joists present in the walls and ceilings of residential, commercial and industrial structures, to secure an opposing side of a piece of wallboard, such as gypsum drywall wallboard, are not aligned with an existing stud or joist. This avoids the necessity of fitting up or cutting the wallboard to size, thus saving time and reducing the extent of undesirable scrap. The corner-fastening member is selectively attached to a corner frame member to form a mounting surface for a wallboard member extending outwardly from the corner during installation. The fastening members of the invention are desirably formed in a particular manner to allow the user to easily adjust their length, and to allow fastening devices such as screws, staples, nails or the like to be easily secured thereto. Thus, the fastening members provide a mounting surface for the wallboard members, being formed to extend from support members in the frame construction at a location adjacent the edge of a standard wallboard member to secure the wallboard member in position without cutting or otherwise modifying the member based upon the position of the frame construction. Both the flat and corner fastening members are elongated members, with the flat fastening member preferably being formed on one side to have a stepped configuration as shown in the inventor's prior U.S. Pat. No. 5,987,846, which is hereby incorporated by reference. This configuration permits the fastening member to fasten adjacent pieces of wallboard having the same thickness using the side having the flat configuration and adjacent pieces of wallboard having different thicknesses by using the side having a stepped configuration. The corner fastening members may be configured for alternative corner configurations typically found in building structures, such as for example 90° and 120° corners, but any suitable angle is contemplated. The fastening members are preferably constructed of a material that is easily scored to allow a section to be broken or separated at the score line to thereby have its length easily and quickly adjusted. Equivalently, the member could have score lines formed at intervals to permit the length of wallboard fastening member to be easily and quickly adjusted.

Other advantages and novel features of the present invention will become apparent in the following detailed description of the invention when considered in conjunction with the accompanying drawings.

DETAILED DESCRIPTION OF THE DRAWINGS

In the following detailed description of a preferred embodiment of the present invention, reference is made to the accompanying drawings which, in conjunction with this detailed description, illustrate and describe embodiments of a wallboard installation method and fastening members in accordance with the present invention.

Figure 1:
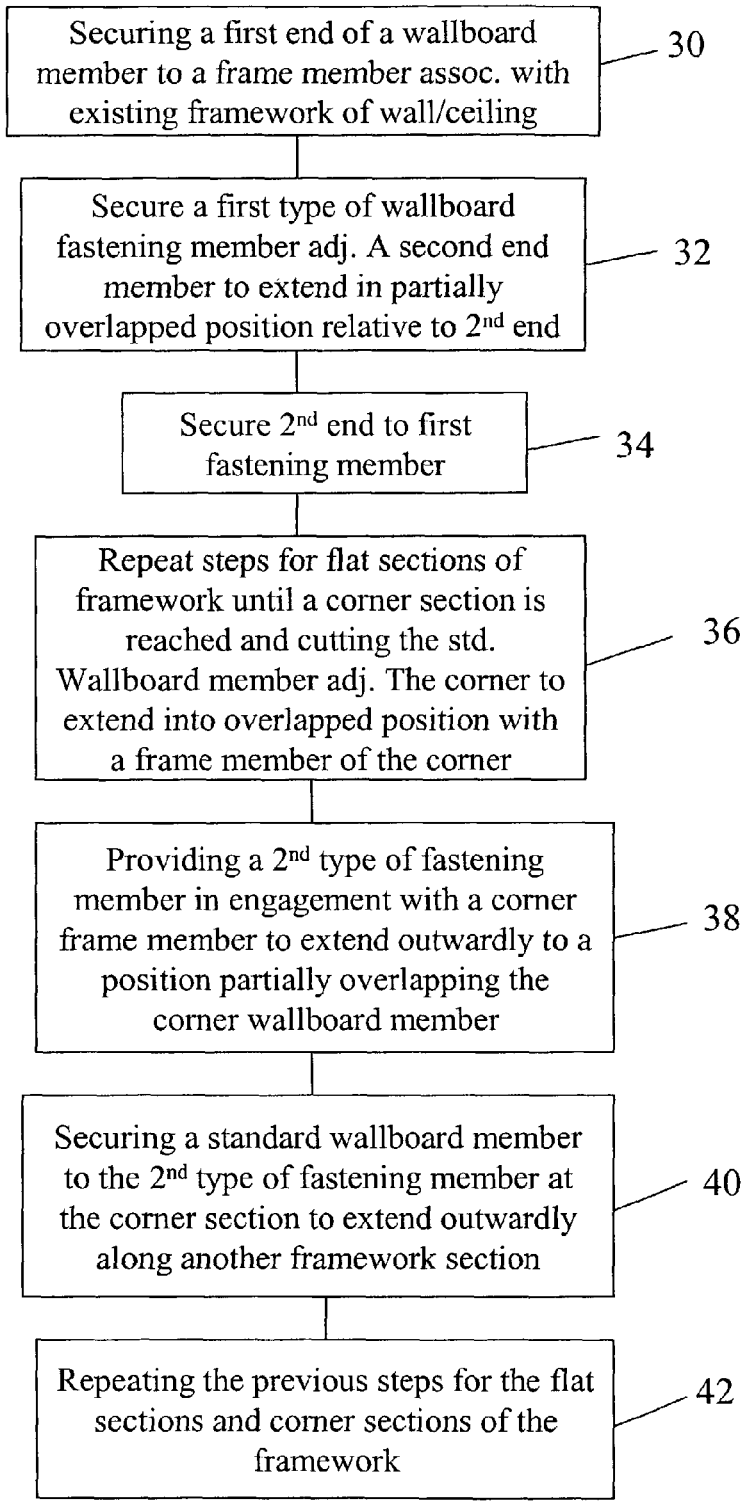
FIG. 1 illustrates the method according to an embodiment of the invention.

The method according to the invention is shown in FIG. 1, and comprises the steps for installation of wallboard members on a framework having a plurality of frame members arranged relative to one another to form at least one wall/ceiling surface section and at least one corner section. The first step of an installer is to locate the position of a first standard wallboard member and secure it to an existing frame member of the framework at 10, which typically will start from a corner section to extend along a portion of a flat wall/ceiling section. When referring to a corner section, it should be understood that either inside or outside corner configurations are contemplated. As will be seen, the particular starting position does not depend on the characteristics of the framework. The first end of the standard wallboard member is secured to existing frame member of the at least one wall/ceiling surface section at 30 by suitable securing devices, such as screws, staples, nails or any other device designed for this purpose. A second step provides a first type of wallboard fastening member and securing the fastening member in a position adjacent a second end of the first wallboard member opposed to the first end in a partially overlapped position at 32. A third step of the method provides that the second end of the wallboard member is secured to the first type of wallboard fastening member at 34. The steps one through three are then repeated at 36 for additional standard wallboard members using additional wallboard fastening members until a corner section is reached. The wallboard member adjacent the corner is cut to size to extend into overlapped position relative to a frame member at the corner section. In this manner, all but the wallboard member adjacent the corner section are standard wallboard members which have not required cutting or other modifications in their installation. A further step at 38 provides a second fastening member in engagement with the corner frame member to extend outwardly to a position partially overlapping the corner wallboard member. A standard wallboard member is secured to the second type of wallboard fastening member at the at least one corner to extend outwardly along another framework section at 40. The foregoing steps are then repeated for the flat sections and the corner sections of the framework at 42 until all sections of the framework are covered with wallboard in the desired manner.

Figure 2:
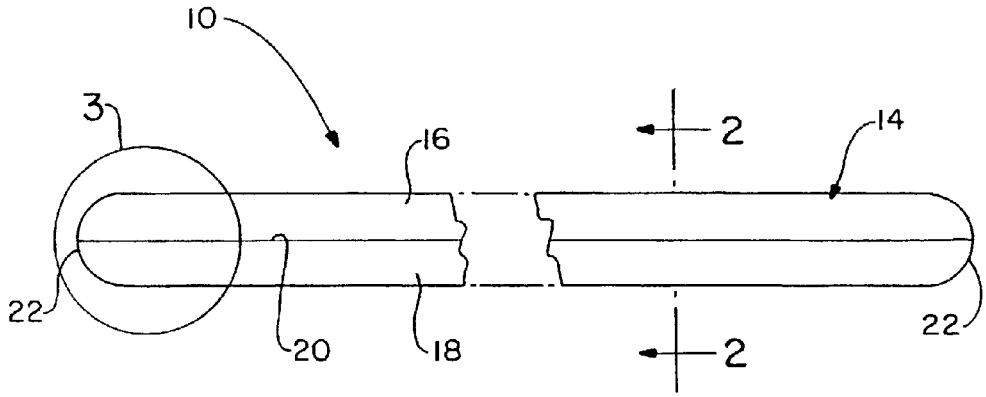
FIG. 2 illustrates a top elevational view of a fastening member in accordance with a first embodiment of the present invention.

Referring to FIG. 2, a top elevational view of a first type of wallboard fastening member generally identified by reference number 10. In this embodiment, the first type of wallboard fastening member may be similarly configured to that shown in U.S. Pat. No. 5,987,846. Also in a preferred embodiment, the member 10 is manufactured of a material which allows it to accept standard securing devices such as screws, staples, nails or the like, such as a polymeric, wood or composite material. For ease of manufacture, the material can be of a type which is molded or extruded into the desired shape. A suitable material is desirably somewhat flexible to facilitate handling and use, but has strength when fastened in conjunction with wall board members to maintain and support the seam between wallboard members attached thereto. The material also desirably is fire retardant, such as meeting the test requirements as set forth in ASTM E119 *'Standard Test Method for Fire Test of Building and Construction Materials'*, or the like. As an example, the material may be a HDPE material which is extruded into the desired shape and lengths. Alternatively, the material could be a mixture of wood flour with HDPE and an amount of a lubricant to facilitate dispersal and mixing of the materials. The material and configuration is preferably designed to comply with regulations and standards relating to wallboard materials, so as to match the mechanical and physical properties of the members themselves. For example, in the use of the fastening members according to the invention, as the edges of members are attached to the fastening member away from a stud or joist, the strength of the seam produced is desired to comply with the mechanical strength and impact standards typical in the industry. Similarly, the material used to make the fastening members should be compliant with safety related regulations, such as for example the fire resistant characteristics of the fastening members. The fastening members of the invention may also be used to strengthen particular areas that are susceptible to damage, such as for example, the area behind a door in a home or building. The wallboard in such areas are particularly prone to damage from the opening of the door, particularly before any door stop is installed, such as in new construction. A fastening member may be located behind the wallboard at this location to reinforce it and avoid damage to the wallboard. Using a material such as set forth above, the fastening member according to the invention can then be made by extruding desired lengths of material and curing to a relatively rigid construction. This type of material is also easily scored using the sharp point of a screw or nail, a utility knife or the like, allowing the user to simply bend the member at the location of the score line to form a clean break at the score line. In this manner, the user can easily adjust the length of the member if needed for use in a particular circumstance. Other materials having the characteristics as desired are suitable and contemplated by the invention, such as paper emulsions, metallic materials, such as steel and aluminum, wood, including processed wood materials, and composite materials, such as fiberglass. The thickness of the members 10 is sufficient to allow it to be secured in position and for wallboard members to be secured thereto. A reinforcing material, such as a reinforcing fiber, may be provided to strengthen the members as needed for a particular application.

Figure 3:
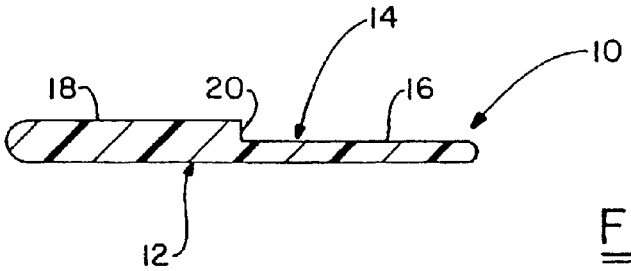
FIG. 3 illustrates a cross-sectional view of the fastening member shown in FIG. 2.

Referring to FIG. 3, which illustrates a cross-sectional view of the preferred embodiment of a fastening member shown in FIG. 2. It is seen that the first type of wallboard member 10 is substantially flat, and that wallboard fastener member 10 includes first side 12 and second side 14. In the embodiment shown, one of the sides may be configured to have a stepped configuration including lower surface 16 and upper surface 18 separated by step 20. First side 12 is placed against the adjacent edges of wallboard pieces when utilizing wallboard fastener member 10 to fasten pieces of wallboard having the same thickness. Second side 14 is utilized when fastening pieces of wallboard having different thicknesses with lower surface 16 being placed against the edge of the piece of wallboard having the greater thickness and upper surface 18 being placed against the edge of the piece of wallboard having the lesser thickness.

In the preferred embodiment of wallboard fastener member 10 shown in the drawings, wallboard fastener member 10 is approximately five (5) feet in length to accommodate wallboard having a width of fourth eight (48) inches and/or fifty four (54) inches and is approximately three (3) inches wide to provide sufficient space to allow adjacent pieces of wallboard to wallboard fastener member 10 to be secured thereto using screws, staples or the like. However, if desired, wallboard fastener member 10 could be fabricated in other lengths and widths. The wallboard fastener member 10 is dimensioned to allow at least two (2) pieces of wallboard to be readily secured together at their edges to wallboard fastening member 10, and the fastening member provides sufficient strength to resist slight movement between the installed pieces of wallboard due to, for example, settling, expanding and/or contracting. The thickness between first side 12 and lower surface 16 of second side 14 is preferably approximately one eight (⅛) of an inch and the thickness between first side 12 and upper surface 18 of second side 14 is preferably approximately one quarter (¼) of an inch. It is preferable for wallboard fastener member 10 to be as thin as possible while also providing the desired structural integrity, to make it as inexpensive as possible and to facilitate handling and transport of the members. In the desired configuration, the characteristics of the member 10 allow it to be easily scored, and bent to snap the member 10 at the score line to the desired length.

Figure 4:
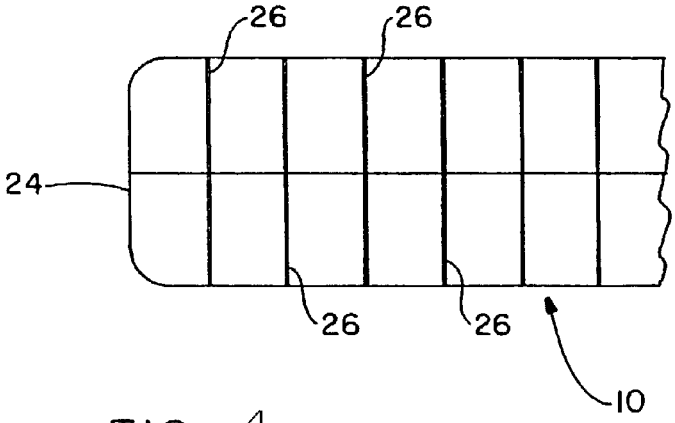
FIG. 4 illustrates a partial top elevational view of a corner-fastening member in accordance with a first embodiment of the present invention.

The ends 22 of wallboard fastening member 10 may be rounded, or tapered 24, as shown in FIG. 4, to facilitate installation of wallboard fastening member 10 and reduce grabbing or catching of insulation, studs, joists and/or other objects. As mentioned previously, wallboard fastening member 10 may be formed to allow score lines to be formed at a desired location and snapped along these score lines to provide for custom fits. Alternatively, if desired, score lines 26, such as partial depth grooves or the like, can be provided at predetermined intervals or positions along the length of the member 10 or at particular locations, such as shown in FIG. 4.

In use, wallboard fastening member 10 is supported to partially overlap the edge of a wallboard member to allow a further wallboard member to be attached to the fastening member at the seam between the wallboard members if the seam does not fall on a frame member of the wall/ceiling, regardless of the side of the wallboard the seam is on. The wallboard member can be secured to the fastening member 10 at the location of partial overlap, while providing a support surface for an adjacent wallboard member to be hung. The width of the fastening member preferably allows the wallboard members to be secured at a position spaced from the edge to significantly increase the strength and reliability of the seam formed thereby and avoid the problems associated with securing board members to a stud or joist at a position more directly adjacent the edges of the wallboard members. If the two adjacent pieces of wallboard being fastened are the same thickness, first side 12 of wallboard fastening member 10 is placed on the backside of the adjacent edges of the at least two (2) pieces of wallboard. On the other hand, if the thickness of the at least two (2) pieces of wallboard being fastened are different, for example, if one piece of wallboard has a thickness of approximately five eights (⅝) of an inch and another piece of wallboard has a thickness of approximately one half (½) inch, second side 14 is placed on the backside of the adjacent edges of the at least two (2) pieces of wallboard, with lower surface 16 of second side 14 being placed against the backside of the adjacent edge of the piece of wallboard having a thickness of approximately five eights (⅝ ) of an inch and upper surface 18 of second side 14 being placed against the backside of the piece of wallboard having a thickness of approximately one half (½) inch.

Another use for wallboard fastener member 10 in accordance with the present invention is for covering the outwardly extending flange from, for example, plumbing fixtures, such as a tub, prior to installing wallboard. In addition, wallboard fastener member 10 may be placed over the top plate of a wall beneath a truss. Pieces of wallboard may then be fastened directly into wallboard fastener member 10 adjacent to each side of the top plate for approximately the first thirty (30) inches to preclude "nail popping" and "tape shear" which often occurs in this area due to relative expansion and contraction of materials resulting from temperature changes, in particular seasonal temperature changes. Furthermore, wallboard fastener member 10 can be used behind pieces of wallboard, which are offset or staggered in their longitudinal direction when installed onto a wall or ceiling.

Figure 5:
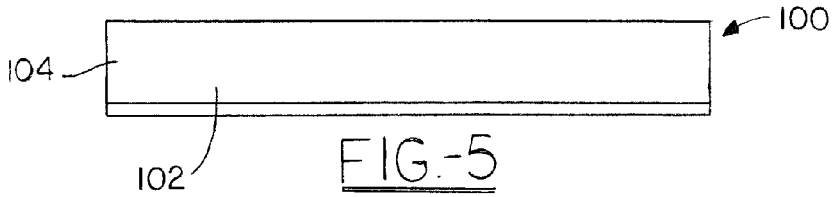
FIG. 5 illustrates a top elevational view of an alternative corner-fastening member in accordance with the present invention.
Figure 6:
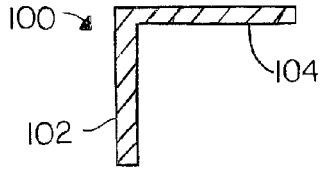
FIG. 6 illustrates a cross-sectional view of the corner-fastening member shown in FIG. 5.
Figure 7:
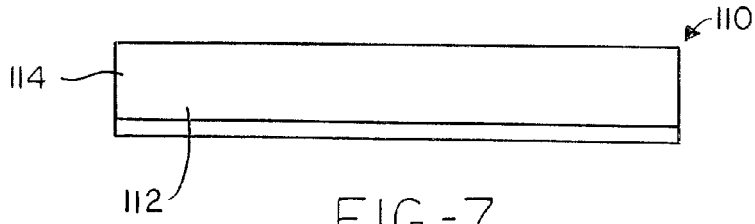
FIG. 7 illustrates a top elevational view of an alternative corner-fastening member in accordance with the present invention.
Figure 8:
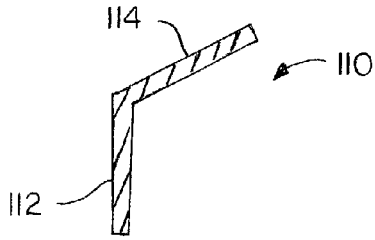
FIG. 8 illustrates a cross-sectional view of the corner-fastening member shown in FIG. 7.
Figure 9:
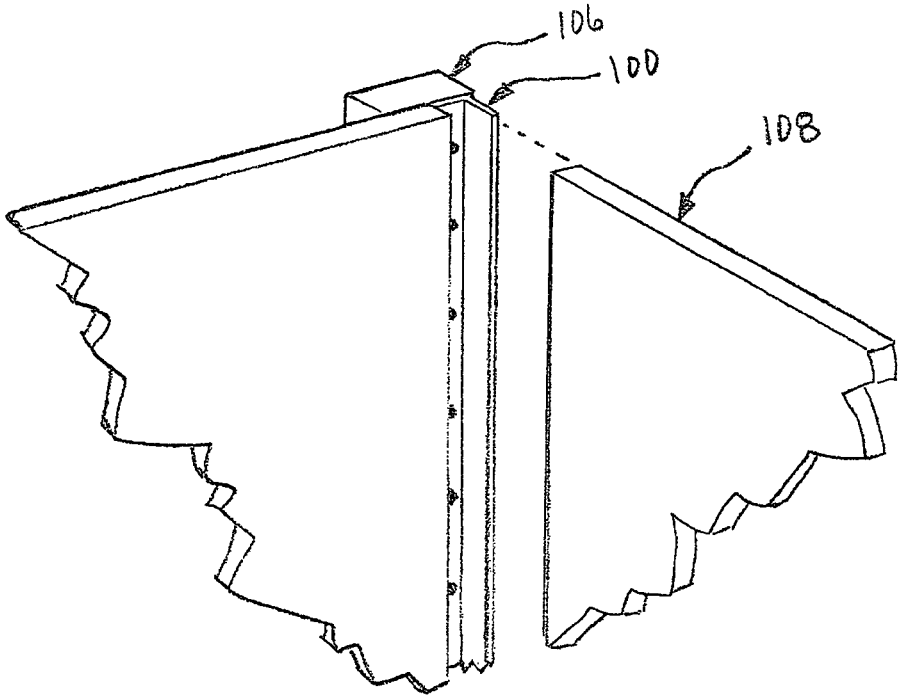
FIG. 9 illustrates a perspective view of the corner fastening member shown in 5 as applied to a corner.
Figure 10:
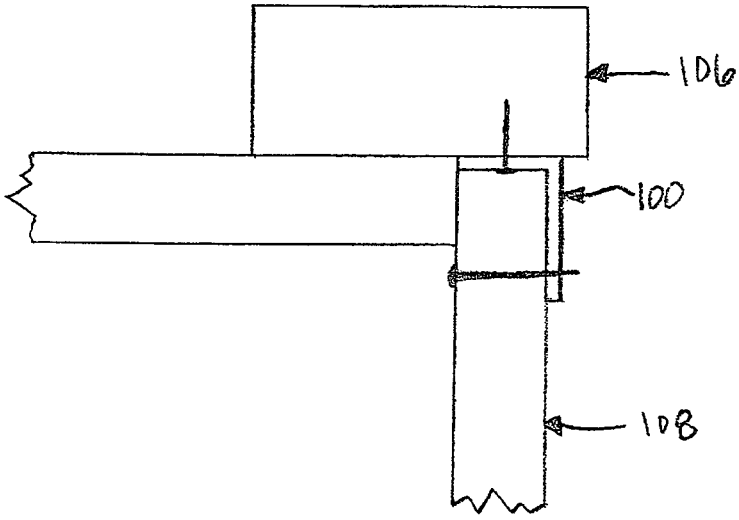
FIG. 10 illustrates a top-view of the corner fastening member applied to a corner shown in FIG. 9.
Figure 11:
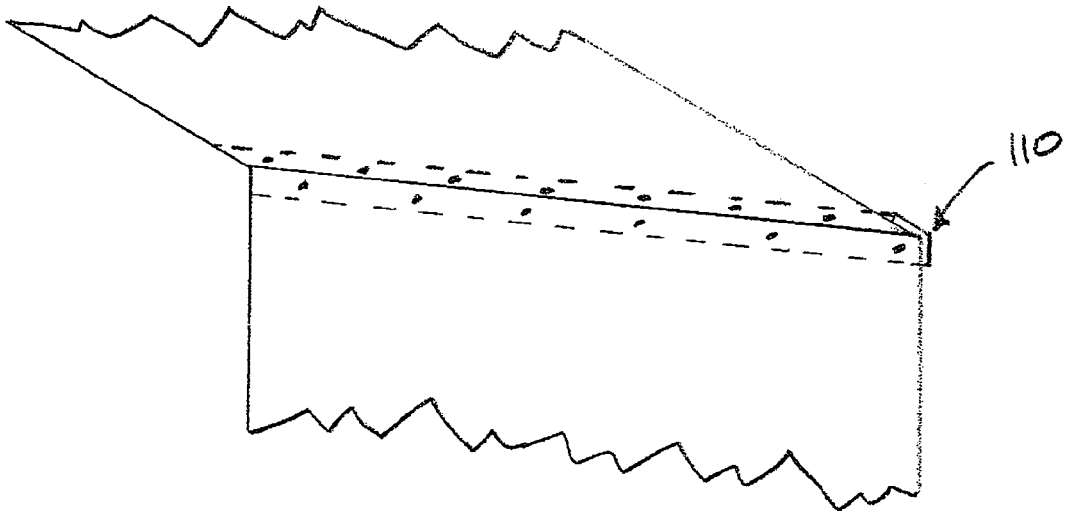
FIG. 11 illustrates a perspective view of the corner fastening member shown in FIG. 5 as applied to a corner not including a frame member.
Figure 12:
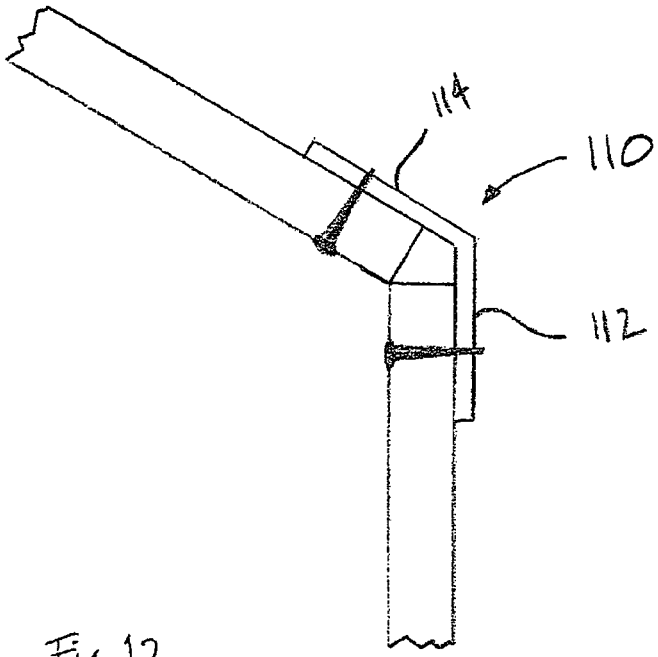
FIG. 12 illustrates a top-view of the corner fastening member applied to a corner shown in FIG. 11.
Figure 13:
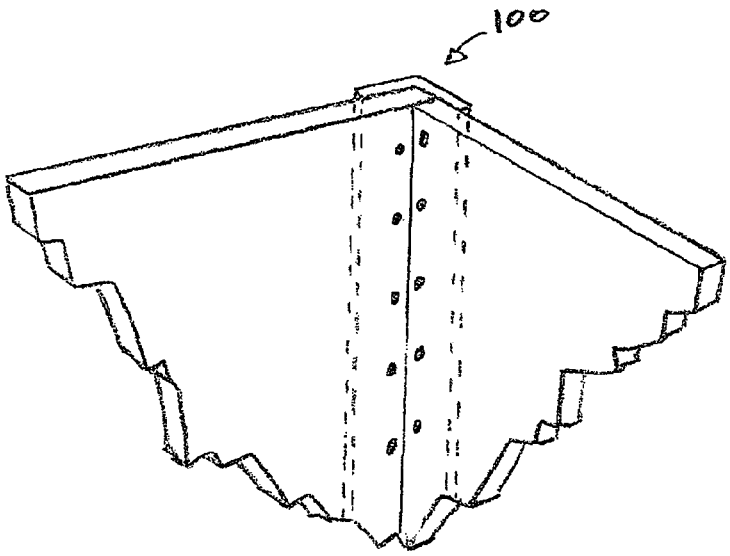
FIG. 13 illustrates a perspective view of the installation of the fastening member 100 as a corner-fastening member.
Figure 14:
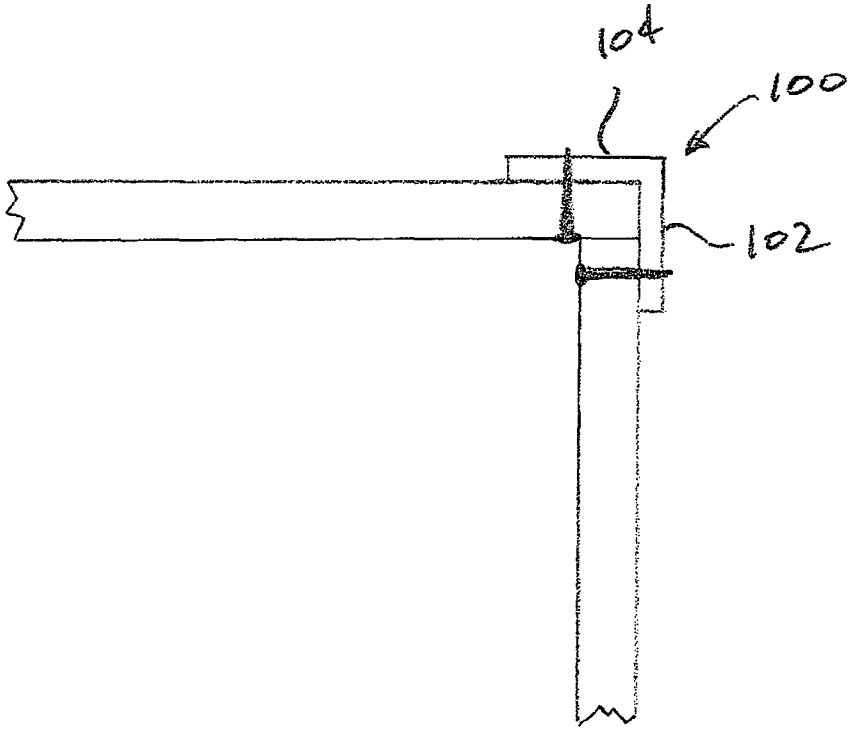
FIG. 14 is a top plan view of the installation of the corner member 100 of FIG. 13.

At the corner sections of a framework defining a wall/ceiling construction, unique problems are present. The present invention is directed to simplify hanging wall board members in the vicinity of the corner section. In framing of a room or the like, corner sections are produced by adjacent frame members which are angled to one another to form a corner, either outside or inside corners. When approaching a corner, a wallboard member coming into a corner section is cut to the right dimensions to overlap the frame member at the corner. In many instances, the seam created at the corner does not fall on a frame member, such that there is no support surface for the next board to be attached to. In this instance, a second type of corner-fastening member is used to form a support surface for the seam at the corner section. As shown in FIGS. 5-8, alternative corner fastening members for various typical circumstances are provided for use at corner seams or possible other situations where the seams do not fall appropriately on a frame member. In FIGS. 5-6, a fastening member 100 has first and second orthogonal flanges 102 and 104. At a corner seam location, as shown in FIGS. 9-10, one of the flanges 102 or 104 is secured to an adjacent frame member 106, such that the other flange 102 or 104 extends outwardly from the frame member. This outwardly extending portion then may serve as a support surface for the next wallboard section 108 extending out from the corner section. In FIGS. 7-8, a fastening member 110 also includes first and second flanges 112 and 114, but the flanges are at a 120° angle relative to one another. In many situations, the corner section of a wall/ceiling is not orthogonal, but instead is at a 120° angle or some other angle. Fastening members 110 may be provided for any such configurations, to allow one of the flanges to be attached to an adjacent frame member, with the other flange extending outwardly to serve as a support surface for an adjacent wallboard member at the seam. For example, 120° corners may be provided in a room of a structure wherein the framing to form the 120° corners generally may meet at the inside corner of the wall. Although this may provide suitable supporting structure for wallboard members on the inside corner, the outside corner of this structure does not have frame member which meet at the corner, thereby not providing any support for the wallboard members coming into the outside corner at the seam therebetween. In an alternate application, as best shown in FIGS. 11 and 12, the fastening member 110 may be used in this circumstance to provide support at the seam for both wallboard members, and also allows the installer to use a trim gun or stapler on such a seam to secure a corner bead over the outside corner section at the seam. For cathedral ceilings, the seams forming the peak of the ceiling are generally not on frame members, and again a fastening member of the invention may be used to strengthen this seam and prevent separation at such locations. The fastening members 100 and 110 may be constructed of similar material and have similar desired characteristics to the fastening member 10 as described previously.

Because the invention allows an installer to avoid measuring and cutting wallboard members so that an edge of the wallboard member falls on a frame member of a wall/ceiling structure, no special skill is needed to properly hang the wallboard, and any waste produced is minimized. Regardless of the particular location of a seam, if it does not fall on a frame member to allow adjacent wallboard sections to be attached to the frame member, one of the fastening members can be used to provide attachment and support surfaces for each wallboard section at the seam. In this way, an installer can more quickly cover a wall/ceiling section, while further reducing costs by avoiding the generation of scrap. The method of the invention allows an installer to select standard wallboard members and position them on a wall/ceiling surface without cutting, with any seams where at least one of the adjacent wallboard members is not on a frame member of the wall/ceiling structure being supported using a fastening member according the invention. The advantages of the wallboard fastening system and methods in accordance with the invention in saving time and materials are significant, and unskilled labor can be used. Time saved further includes that time previously spent on scaffolding and benches for premeasurements. In addition, as the amount of wallboard scrap is reduced, the footage of wallboard paid for by the owner or contractor is reduced. By supporting every seam between wallboard members, the occurrence of nail pops due to relative movement between the wallboard members is eliminated or reduced, and instead the fastening members allow the adjacent wallboard members to float together if expansion or contraction occurs with temperature swings, or settling.

Although the present invention has been described above in detail, the same is by way of illustration and example only and is not to be taken as a limitation on the present invention. For example, other modifications to and uses for wallboard fastener member 10 could be readily utilized in accordance with the teachings of the present invention. Accordingly, the scope and content of the present invention are to be defined only by the terms of the appended claims.

What is claimed is:

1. A sheet member corner support system comprising at least one corner fastening member comprising a first flange and a second flange extending transverse to each other at a predetermined angle, the first flange selectively attaching to an unexposed side of an unsupported first sheet member edge and the second flange extending outwardly away from the first flange and attaching to an unexposed side of a second sheet member edge, the corner fastening member securing and supporting the sheet member to support a corner of a wall/ceiling surface formed thereby, and wherein said unexposed sides of said first and second sheet members comprise those sides adjacent frame members to which said sheet members are attached.

2. The fastening system of claim 1, wherein the at least one corner fastening member are formed of a material which allows a fastening device to be secured thereto.

3. The fastening system of claim 2, wherein the fastening device is selected from the group consisting of a screw, nail or tack.

4. The fastening system of claim 1, wherein the fastening member is formed of an extrudable material that is composite material that can be molded or extruded into the desired shape.

5. The fastening system of claim 4, wherein the extrudable material is selected from the group consisting of a polymeric material, a mixture of wood fiber with a binder material and a composite material.

6. The fastening system of claim 1, wherein the predetermined angle between the flanges is an angle selected from the group consisting of ninety or one hundred twenty degrees.

* * * * *